US008324841B2

(12) United States Patent
Kleeven et al.

(10) Patent No.: US 8,324,841 B2
(45) Date of Patent: Dec. 4, 2012

(54) TWIN INTERNAL ION SOURCE FOR PARTICLE BEAM PRODUCTION WITH A CYCLOTRON

(75) Inventors: Willem Kleeven, Pellenberg (BE); Michel Ghyoot, Louvain-la-neuve (BE); Michel Abs, Bossiere (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 12/742,902

(22) PCT Filed: May 29, 2009

(86) PCT No.: PCT/EP2009/056673

§ 371 (c)(1), (2), (4) Date: May 13, 2010

(87) PCT Pub. No.: WO2009/150072

PCT Pub. Date: Dec. 17, 2009

(65) Prior Publication Data

US 2011/0068717 A1 Mar. 24, 2011

(30) Foreign Application Priority Data

Jun. 9, 2008 (EP) ..... 08157892

(51) Int. Cl.
*H05H 13/00* (2006.01)

(52) U.S. Cl. ..... 315/502; 315/500; 315/507; 313/62

(58) Field of Classification Search ..... 315/502, 315/500, 507; 313/62

See application file for complete search history.

(56) References Cited

U.S. PATENT DOCUMENTS 3,866,132 A 2/1975 Gorka, Jr.

(Continued)

FOREIGN PATENT DOCUMENTS

WO 97/14279 A1 4/1997

OTHER PUBLICATIONS

The isochronous cyclotron: principles and recent developents, Karel Strijckmans, Institute for Nuclear Sciences, Ghent University, INW-RUG, Proeftuinstraat 86, B-9000, Gent, Belgium, Apr. 20, 2000, Computerized Medical Imaging and Graphics 25 (2001) 69-78.*

(Continued)

*Primary Examiner* — Douglas W Owens
*Assistant Examiner* — Jonathan Cooper
(74) *Attorney, Agent, or Firm* — Fitch, Even, Tabin & Flannery, LLP

(57) ABSTRACT

The present invention relates to a cyclotron including two internal ion sources for the production of the same particles. The second ion source can be used as a spare ion source which strongly increases the uptime and the reliability of the cyclotron and reduces the maintenance interventions. Advantageously, the cyclotron is further characterized by an optimized close geometry of the different elements within the central region of the cyclotron. The cyclotron of the invention may be further characterized by an adaptation and optimization of the shape of first and second internal ion source to avoid particle losses during the first turn of acceleration. The cyclotron may be further characterized by an adaptation and optimization of the shape of the counter-Dee electrode assembly and possibly the Dee-electrode assembly in order to improve the acceleration field in-between the gaps.

7 Claims, 7 Drawing Sheets

U.S. PATENT DOCUMENTS

| | | | | |
|---|---|---|---|---|
| 4,780,682 | A * | 10/1988 | Politzer | 315/507 |
| 6,057,655 | A | 5/2000 | Jongen | |
| 6,462,348 | B1 | 10/2002 | Gelbart | |

OTHER PUBLICATIONS

M. Abs et al., "A New Design of Truly Selfshielding Baby-Cyclotrons for Positron Emitter Production." Proceedings of the 1989 IEEE Particle Accelerator Conference. Accelerator Science and Technology (Cat. No. 89CH2669-0) IEEE New York, NY, USA, 1989, vol. 1, pp. 675-677.

E. Conard et al., "Current Status and Future of Cyclotron Development at IBA" Proceedings of 2nd European Particle Accelerator Conference, Jun. 1990, pp. 419-421.

K. Jimbo et al., "Volume Production of Negative Hydrogen and Deuterium Ions in a Reflex-Type Ion Source." Nuclear Instruments & Methods in Physics Research, Section A (Accelerators, Spectrometers, Detectors and Associated Equipment) Netherlands, vol. A248, No. 2-3, Aug. 1, 1986, pp. 282-286.

G. Ciavola et al., "Operational Experience With the 450 kV Injector for the Superconducting Cyclotron," Nuclear Instruments & Methods in Physics Research, Section A (Accelerators, Spectrometers, Detectors and Associated Equipment) Netherlands, vol. 382, No. 1-2, Nov. 11, 1996, pp. 192-196.

V.P. Dmitrievsky et al., "Experimental Study of Simultaneous Acceleration of Protons and H-Ions in the Cyclotron." Proceedings of the 1st European Particle Accelerator Conference, Jun. 1988, pp. 616-618.

P. Heikkinen et al., "Cyclotron Development Program at Jyvaskyla." AIP Conference Proceedings AIP USA, No. 600, 2001, pp. 89-93.

L. Calabretta et al., "High Intensity Proton Beams From Cyclotrons for H2<+>." Proceedings of the 1999 Particle Accelerator Conference (Cat. No. 99CH36366), IEEE Piscataway, NJ, vol. 5, 1999, pp. 3288-3290.

H. Ryuto et al., "Charge Strippers for Acceleration of Uranium Beam at Riken Ri-Beam Factory." 18th International Conference on Cyclotrons and Their Applications, 2007, Giardini naxos, Italy, p. 314.

R. Richardson. "Meson Factories." IEEE Transactions on Nuclear Science USA, vol. NS-12, No. 3, Jun. 1965, pp. 1012-1026.

International Application No. PCT/EP2009/056670, Notification of Transmittal of the International Search Report and the Written Opinion of the International Searching Authority, or the Declaration, date of mailing Sep. 3, 2009, 12 pages (related application).

International Application No. PCT/EP2009/056673, Notification of Transmittal of the International Search Report and the Written Opinion of the International Searching Authority, or the Declaration, date of mailing Sep. 3, 2009, 12 pages.

* cited by examiner

TWIN INTERNAL ION SOURCE FOR PARTICLE BEAM PRODUCTION WITH A CYCLOTRON

CROSS REFERENCE TO RELATED APPLICATIONS

This application is a national phase application of International Application No. PCT/EP2009/056673, filed May 29, 2009, designating the United States and claiming priority to European Patent Application No. 08157892.4, filed Jun. 9, 2008, both of which are incorporated by reference herein in their entirety.

FIELD OF THE INVENTION

The present invention relates to the field of cyclotron accelerators. More particularly, this invention relates to an internal ion source assembly for a cyclotron accelerator.

STATE OF THE ART

A cyclotron is a re-circulation particle accelerator, which operates under high vacuum and in which charged particles, generated by an ion source, are accelerated in a circular motion. This is achieved by using on the one hand a magnetic field which causes the particles, coming from said source, to follow a circular path in a plane perpendicular to said magnetic field, and on the other hand a high-frequency alternating voltage applied to so-called Dee electrodes which impart to particles passing through it an increase of their energy.

An internal ion source typically comprises a cylindrical chamber or ion source body. An electrical field is created between a cathode and an anode. The cathode produces electrons and the electrons follow the magnetic field lines of the cyclotron describing a very small helical path making the electron travel very long from one cathode to the other. A gas (typically a Hydrogen gas or another gas, depending on the particles desired for the particle beam) is injected in the interior of said ion source. The electrons lose part of their energy in the gas during their travel and create ionisation forming consequently a plasma column. Ion sources can produce negatively and/or positively charged ions.

Some cyclotron models are designed with an internal ion source, while others are designed with an external ion source.

In a cyclotron equipped with an internal ion source, the ion source is located within the so-called central region of the cyclotron. Ions generated by said ion source are directly extracted from the ion source body through a slit and pulled out of said slit by a voltage difference applied between the ion source body and an electrode called puller, the latter being biased with a power source at an alternating potential. After extraction from the ion source, ions move through electrodes, typically called Dee's. Cyclotron also comprises: an electromagnet which produces a magnetic field (perpendicular to the direction of particles) for guiding and confining particles in a circular path; and a high frequency power supply which is capable of applying an alternating voltage to said Dee electrodes and therefore rapidly alternating the polarity of the electrical field generated in the gap between said Dee-electrodes. Since the electric field is absent inside the Dee electrodes, particles travelling through Dee electrodes are not affected by the electric field. Thus, if the voltage applied to Dee electrodes is reversed while particles are inside the Dee electrodes, each time particles pass through the gap, they increasingly acquire acceleration following a spiral path by gaining energy. Some cyclotrons are designed for the acceleration of positively charged ions while others are optimized for the acceleration of negatively charged ions. At the end of said spiral path there is an extraction member, such as a carbon stripper which is used to extract accelerated negatively charged ions, e.g. $H^-$. When positively charged ions have been accelerated, an electrostatic deflector is used to realize the extraction of the particles from the cyclotron.

In a cyclotron with an external ion source, ions generated by said ion source are first conveyed from the external ion source within said cyclotron and then inflected for being accelerated similarly to the case of cyclotrons with internal source. An advantage of cyclotrons with an external ion source over cyclotrons with an internal ion source consists in that the ion source is easily accessible for maintenance work, with the vacuum condition always kept. The internal ion sources in a cyclotron are fragile and due to wear need to be replaced regularly. Replacing an internal ion source is cumbersome and takes time: the vacuum is broken, the cyclotron is opened, the ion source is replaced, the cyclotron is closed and the cyclotron is pumped down until good vacuum is obtained.

When cyclotrons are used for commercial production of radiopharmaceutical isotopes (e.g. PET or SPECT isotopes) the uptime and reliability of the beam production become an important and critical factor. To increase uptime and reliability, redundant devices and systems of the cyclotron are installed (e.g. use of multiple stripper elements to extract a $H^-$ beam). In fact, the internal ion source is the only essential element in the cyclotron that is not redundant. Moreover, during the maintenance process when the internal ion source needs to be replaced, personnel performing the maintenance is exposed to radiation from activated materials. Hence for cyclotrons with internal ion sources there is a need to provide an efficient and fast back-up solution in case of failure of the internal ion source during the production of isotopes for radiopharmaceutical purposes, especially for cyclotrons producing short-lived isotopes (e.g. $^{18}F$ half life=110 minutes).

Conard et al., in "Current status and future of cyclotron development at IBA", Proceedings of EPAC Conference, Nice, France (1990), describe two cyclotrons Cyclone 10/5 and Cyclone 18/9 producing two type of particles: protons and deuterons. Two internal cold cathode PIG types of ion sources are used for this purpose. The integration of two ion sources in the same cyclotron for the production of two different particles could technically be achieved because of the different physical properties of the particles: due to the mass difference, the particles have a different magnetic rigidity and as a consequence the particles experience a different bending. For the protons and deuterons these cyclotrons are operated in harmonic 2 and 4, respectively. These different properties allowed installing the two ion sources in a well defined geometrical configuration in the central region of the cyclotron in order for the beam paths of the different particles not to interfere or hit one or the other ion source during the first turn of acceleration. With these cyclotrons it is possible to produce either proton or deuteron beams according to needs for the production of radioisotopes. However, in most practical cases a single type of beam with the best possible uptime is needed for the production of radioisotopes (e.g. protons for the production of $^{18}F$ through the reaction $^{18}O(p,n)^{18}F$).

At present, no practical solution has been proposed so far to increase on the one hand the uptime and reliability of operation of a cyclotron having an internal ion source and on the other hand reduce the exposure of the personnel to radiation during the maintenance process. The present invention aims to provide a solution to the above discussed problems of maintenance and beam uptime.

AIMS OF THE INVENTION

The present invention aims to provide a device which overcomes the problems of the prior art.

In particular the present invention aims to provide a so-called TWIN ion source system where two independent ion sources for producing the same particles are integrated in the central region of a cyclotron.

SUMMARY OF THE INVENTION

According to the preferred embodiment of the present invention, a cyclotron for generating a particle beam is provided, as described in the appended claim. Specific embodiments are described in combination of the independent claim with one or more of the dependent claims. The cyclotron according to the invention comprises:

- a first internal ion source (1) for producing particle ions;
- a Dee electrode assembly (3) and counter-Dee electrode assembly (4) separated from each other by gaps (5) for accelerating said particle ions; said counter-Dee electrode (4) preferably being grounded or generally connectable to a reference voltage; the assemblies may comprise one or more Dee-electrodes and counter-Dee electrodes respectively.
- a generator capable of applying an alternating high voltage to said Dee electrode assembly (3), so that it is possible to have an electric field between (i.e. in) said gaps;
- a means for producing a magnetic field passing vertically through the Dee electrodes for causing the particle ions to spiral and encounter the accelerating voltage of the said Dee electrode assembly many times;
- a second internal ion source (2) for producing the same particle ions as said first internal ion source (1), wherein said cyclotron can generate energetic particle beams produced by either said first internal ion source or by said second internal ion source or by both ion sources simultaneously.

Further according to a preferred embodiment, the cyclotron is characterized by a two-fold rotational symmetry with respect to the central vertical axis. The central vertical axis is defined as the axis going through the centre of the cyclotron and being parallel with the orientation of the magnetic field inside the cyclotron. According to another embodiment, the sources are placed at substantially the same distance from the central axis but not necessarily symmetrically with respect to the central axis.

According to one embodiment, the cyclotron is further characterized by an optimized close geometry of the different elements within the central region of the cyclotron. The distance of the first internal ion source (1) and the second internal ion source (2) with respect to the central vertical axis are minimized to avoid particle losses during the first turn of acceleration. According to this embodiment, the distance of said first internal ion source (1) and said second internal ion source (2) with respect to said central vertical axis is reduced in order to increase the distance between the beam from said first/second internal ion source after travelling 180° and said second/first internal ion source, whereby particle losses during the first turn of acceleration are minimized. In other words, the sources are positioned at the minimum distance which is technically possible, in order to ensure that there is no collision between particles produced by one source with the body of the other source. When the sources are placed symmetrically with respect to the central axis of the cyclotron, a possible collision takes place when the particles have traveled 180° from one source to the other. The minimum technically possible distance depends on the shape of the sources and electrodes, and may be determined by the minimum required distance between the particle sources and the Dee-electrodes.

According to another embodiment, the cyclotron of the invention is further characterized by an adaptation and optimization of the shape of first internal ion source (1) and the second internal ion source (2) to avoid particle losses during the first turn of acceleration. According to this embodiment, the body of said first internal ion source (1) and said second internal ion source (2) comprises a notch (40) at the periphery of said body oriented away from the central vertical axis of said cyclotron. Said notch is arranged to avoid collision of particles produced by one source, with the body of the other source.

According to yet another embodiment, the cyclotron is characterized by an adaptation and optimization of the shape of the counter-Dee electrode assembly (4), and possibly also of the Dee-electrode assembly, in order to improve the acceleration field in-between the gaps (5). According to this embodiment, corners in said counter-Dee electrode assembly (4) at positions where said particle beams cross said gap (5) are reduced, whereby the field-quality of said electric field in the gaps is improved. In other words, the counter-Dee electrode (4) assembly, and possibly also the Dee-electrode assembly (3), is configured in such a way that the crossings of the gap (5) by the particles takes place at areas where there is no corner or bend in said gap (5).

DETAILED DESCRIPTION OF PREFERRED EMBODIMENTS OF THE PRESENT INVENTION

The present invention will be now described in detail in relation to the appended drawings. However, it is evident that a person skilled in the art may conceive several equivalent embodiments or other ways of executing the present invention. The detailed description, the drawings and the calculation results are given with respect to the installation of two internal $H^-$ proton ion sources in a 18 MeV cyclotron. It is evident that the present invention can be applied to any type of cyclotron. The spirit and the scope of the present invention are therefore limited only by the terms of the claims.

Figure 1:
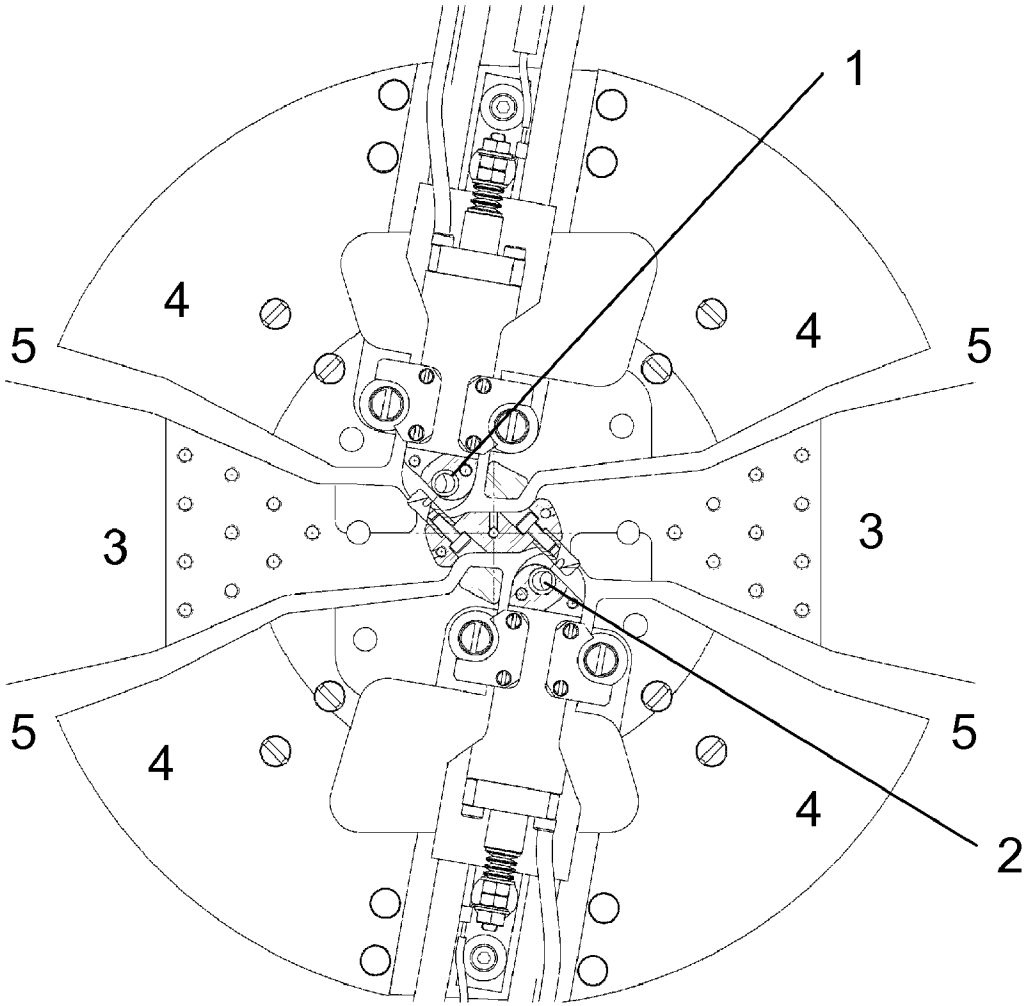
FIG. 1 shows a representation of the central region of a cyclotron according to the invention (projection on the median plane of the cyclotron)

FIG. 1 shows a representation of the central region of a cyclotron according to a preferred embodiment of the present invention. The central region of this cyclotron comprises:

- a first ion source (1) for producing charged particles
- a second ion source (2) for producing charged particles, the second ion source (2) being identical to the first ion source (1)
- a Dee electrode (3) connected to a high frequency power generator, the latter being capable of applying an alternating high voltage to said Dee electrode (3)
- a counter-Dee electrode (4) which is grounded and together with Dee electrode (3) accelerates particles passing through gaps (5).

The Dee-electrode is arranged as a single electrode having two side parts 3, whereas the counter-Dee electrode is arranged as an assembly of four sub-parts 4. Other arrangements with assemblies of one or more Dees and counter-Dees are within the knowledge of the person skilled in the art, and thereby included in the scope of the invention.

Figure 2:
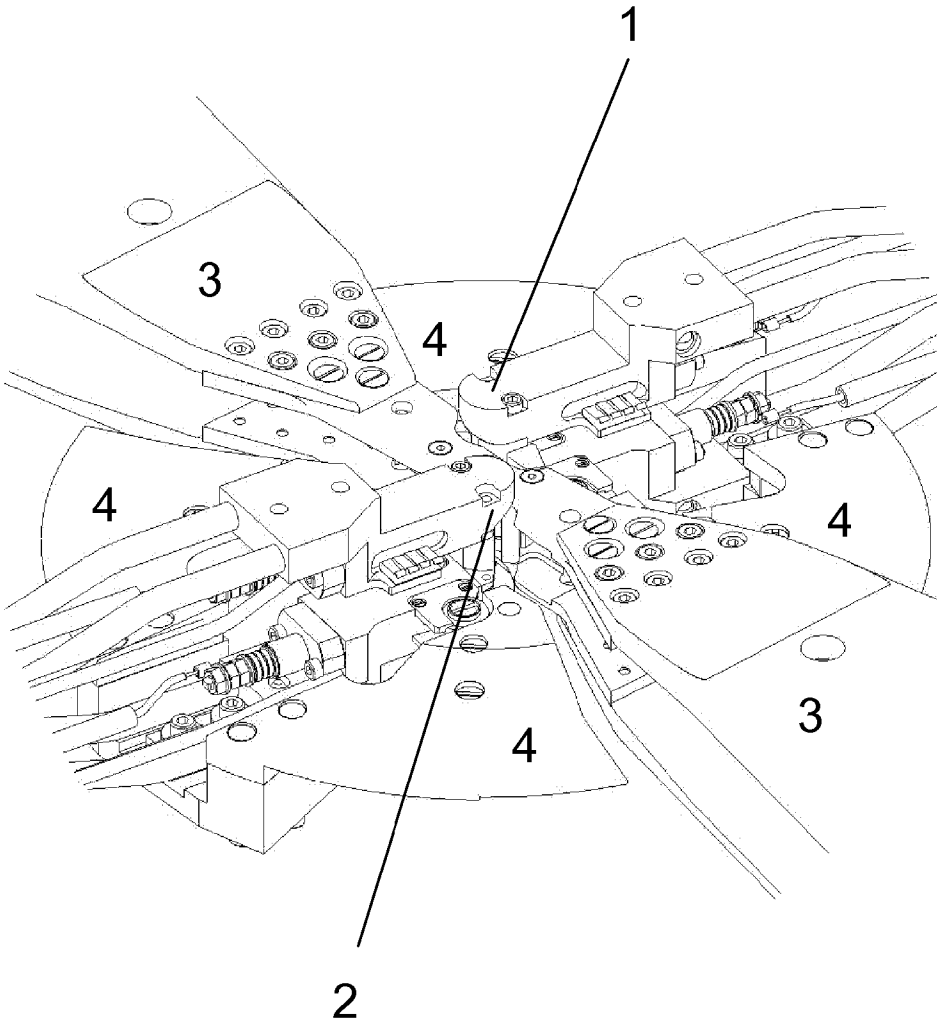
FIG. 2 shows a 3D representation of the central region of the same cyclotron according to the invention.

The cyclotron with the two internal ion sources, as illustrated in FIG. 1 and FIG. 2, has a two-fold rotational symmetry with respect to the central vertical axis. The central axis is here defined as the axis going through the centre of the cyclotron and being parallel with the orientation of the magnetic field. The ion sources are installed in the radial direction with respect to the central axis.

The cyclotron can generate energetic proton beams by either using the first ion source (1) or by using the second ion source (2), or by using both simultaneously.

The ions source (1 or 2), which is typically located at the centre of the particle accelerator, produces low-energy ions that are pulled out from the ion source by the electric field created between the ion source body and puller. Ions are accelerated to the Dee electrode (3) when crossing the first gaps (5) between the Dee electrode (3) and the counter Dees (4) due to the electric field.

Figure 3:
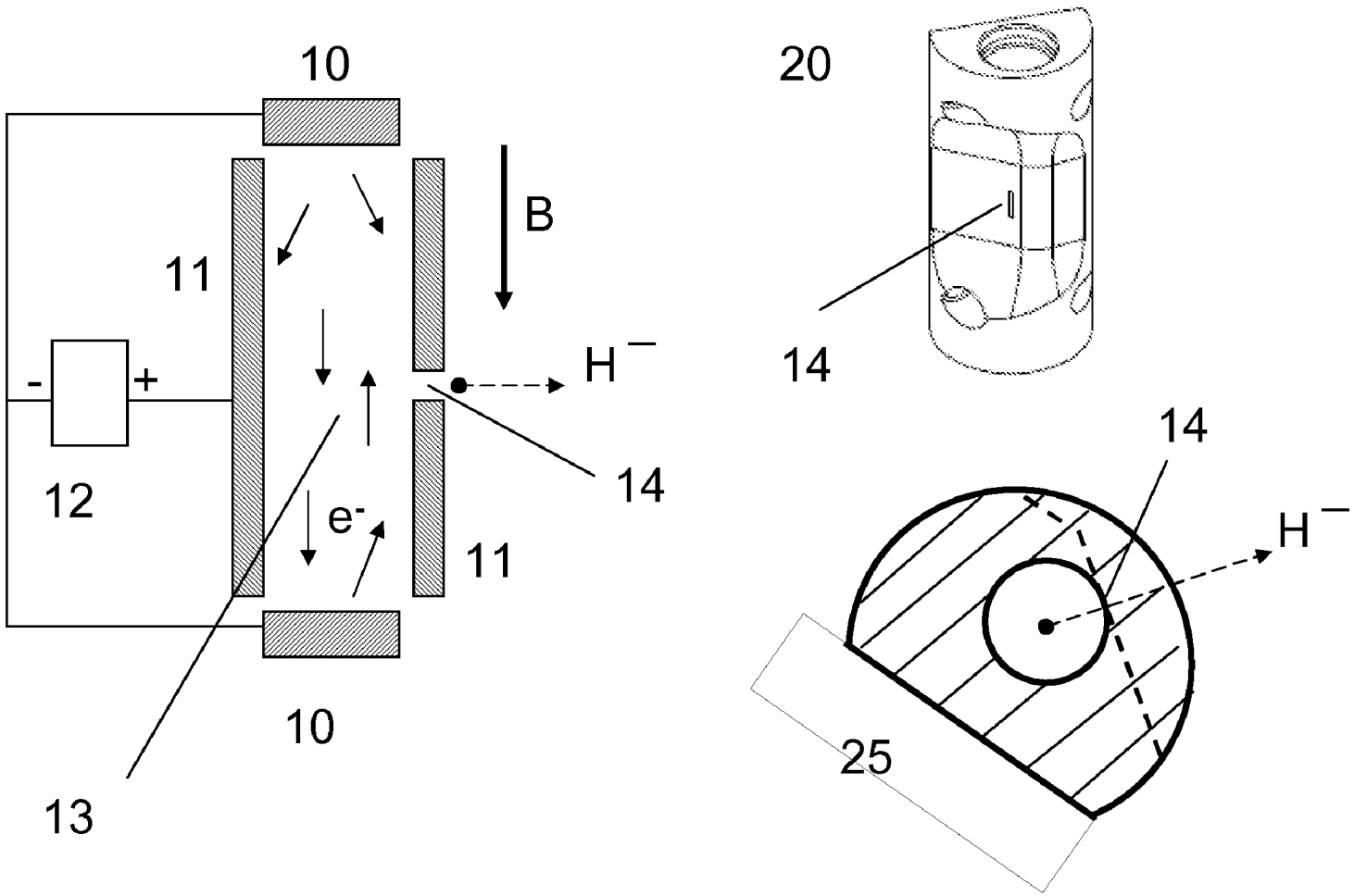
FIG. 3 shows a schematic representation of the working principle of an internal ion source, a perspective view of the body of a typical internal ion source, and a top view of a section of an ion source.

According to the preferred embodiment, the type of ion source that is used is a cold cathode PIG ion source as illustrated in FIG. 3. The ion source is fed with a gas (e.g. hydrogen). An electrical potential is created between anode (11) and cathode (10) using a power supply (12). Electrons are emitted from the cathode and a plasma (13) is created within the so-called chimney of the ion source where electron confinement is established using the magnetic field B of the cyclotron. The ions are extracted through an extraction aperture (14). A three dimensional view of the body of a typical ion source 20 is also shown on FIG. 3 together with a view from the top 25 (cross section along a plane perpendicular to the direction of the magnetic field when installed in the cyclotron).

Figure 4:
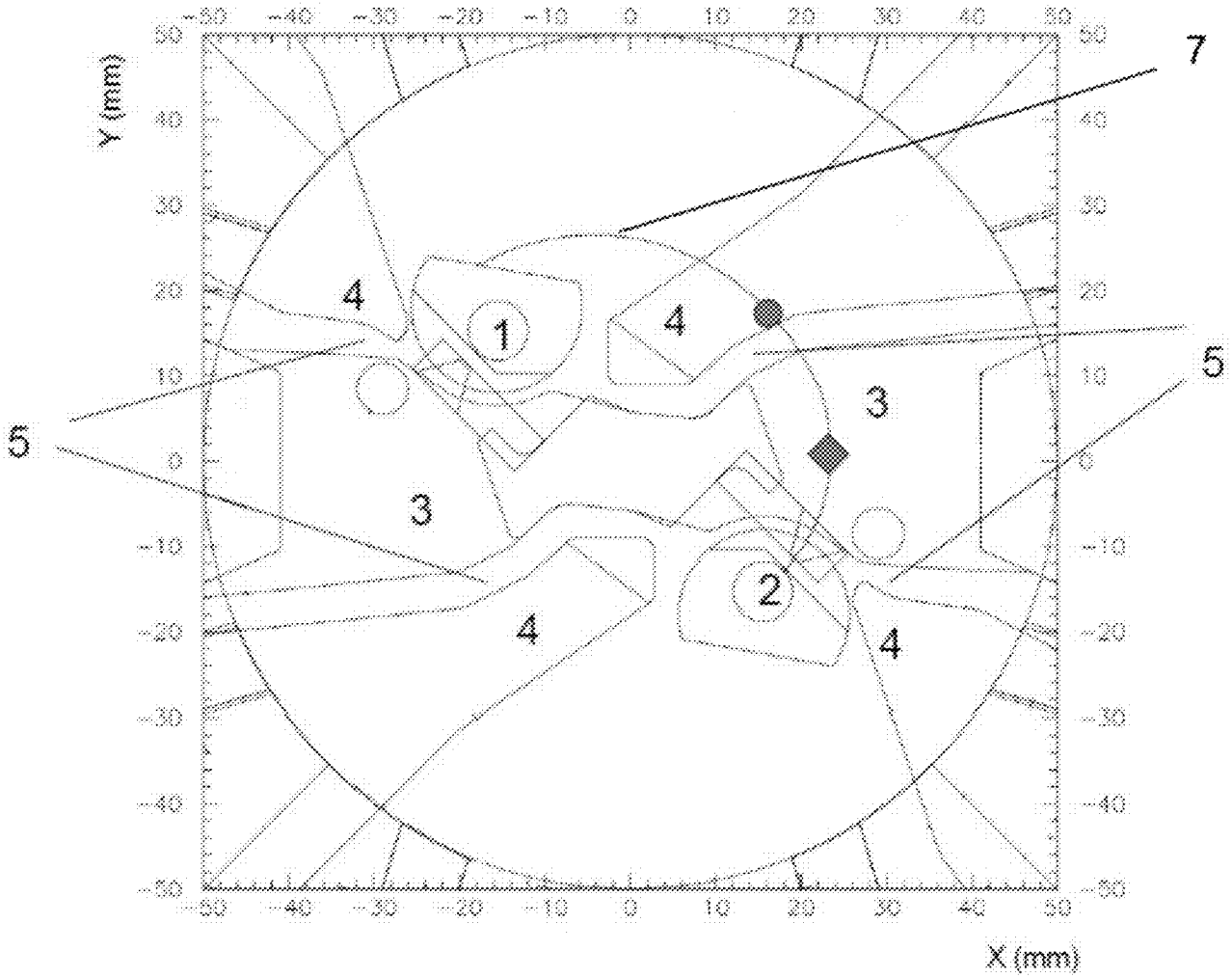
FIG. 4 shows a turn pattern of the ions of the second ion source illustrating the loss of ions during the first turn due to collisions with the first ion source.

As the particles of the two ion sources are identical, the beam optics is exactly the same, i.e. the particles have the same magnetic rigidity and will have the same radius of curvature. As a consequence, particles originating from the first ion source would in general hit the second ion source during the first turn of acceleration. This is illustrated in FIG. 4 which is a view of the median plane of the cyclotron with focus on the central region. The starting point was an existing cyclotron configuration having two internal ion sources: one for protons and one for deuterons (providing beams of 18 MeV protons and 9 MeV deuterons). The deuteron ion source was replaced by a proton ion source, identical to the first proton ion source. The first ion source 1 and the second ion source 2 are shown on FIG. 4 and have the shape as illustrated on FIG. 3 (25). The acceleration and turn pattern of the protons from the second proton ion source (2) were calculated and are shown on FIG. 4, the plain circles and the plane squares represent the position of the protons at the moment when the Dee voltage (3) is maximum and zero, respectively. It is seen that the ions hit the backside of the first ion source (1) that is positioned at 180°, hence all beam is lost already during the first turn of acceleration. Although the twin ion source solution was working for a proton/deuteron cyclotron configuration, the simple replacement of the deuteron ion source with a proton ion source does not work out. The integration of two ion sources in the same cyclotron for the production of two different particles could technically be achieved because of the different physics properties of the particles: due to the mass difference, the particles have a different magnetic rigidity and as a consequence the particles have a different radius of curvature.

In the field of cyclotron research and development, the idea to install within the same cyclotron two internal ion sources for producing the same particles (e.g. protons) has never been imagined. Indeed, an internal ion source is an integrated part of the accelerating and magnetic structure. As the particles of the two ion sources are identical, the beam optics is exactly the same, i.e. the particles have the same magnetic rigidity and will have the same radius of curvature. As a consequence, particles originating from the first ion source would in general hit the second ion source during the first turns of acceleration. In addition, the ion sources have also a certain physical dimension, which makes the integration of two ion sources, producing the same particles, inside the central region of a cyclotron not straightforward and was even never considered.

Figure 5:
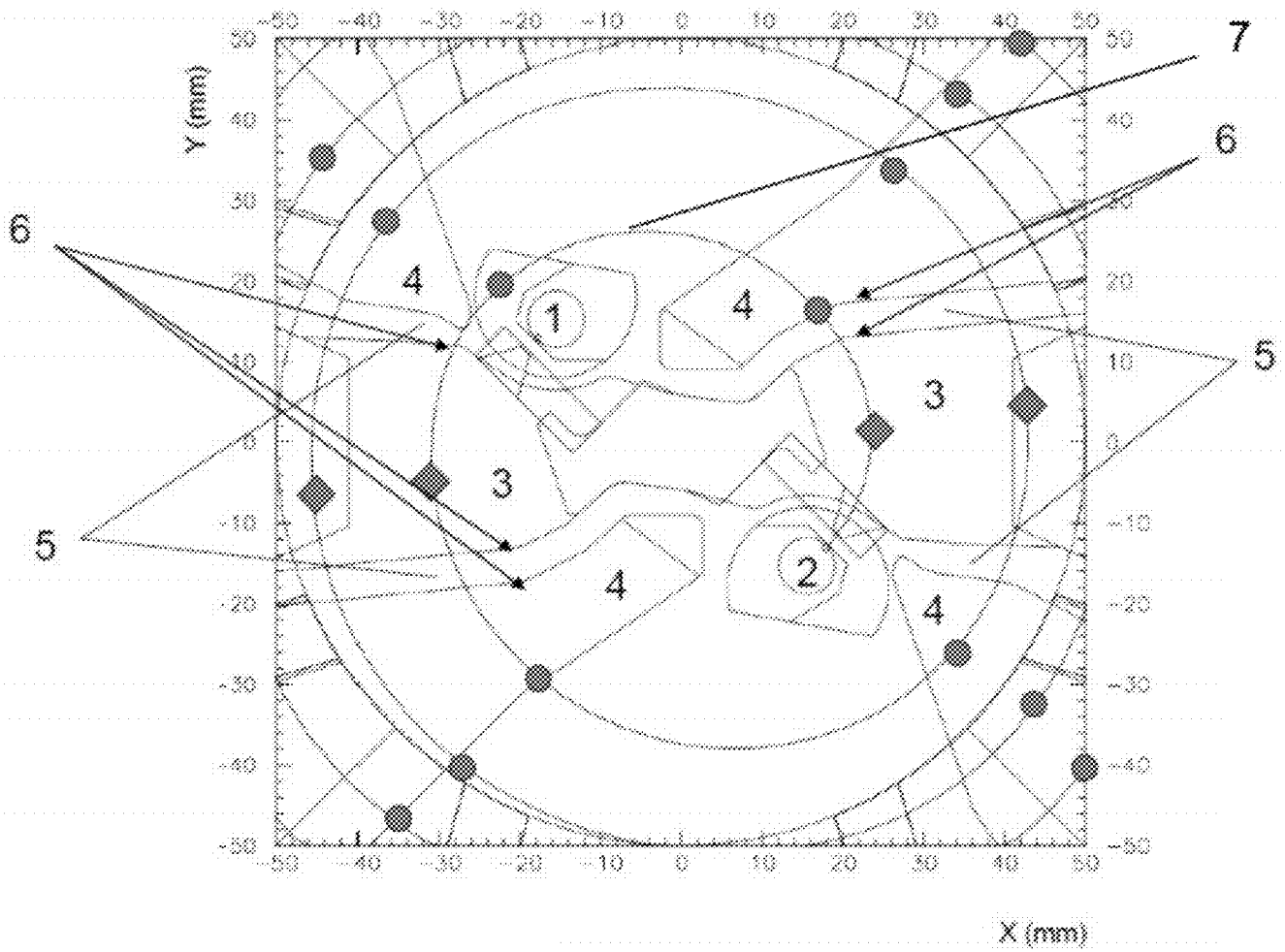
FIG. 5 shows a turn pattern of the ions of the second ion source, where the back side of the first and second ion source have been reshaped.

To solve the technical problem of installing two identical ion sources in the same cyclotron, an iteration process was started to optimize the central region of the cyclotron. Generally according to the invention, the sources are placed in such a way that the particles produced by one source are not obstructed by the body of the other source, when a given magnetic field and acceleration voltage are applied. A first optimization is to modify the shape of the ion sources (1 and 2) to further ensure that the beam makes its first turn without interfering (i.e. colliding) with the second ion source. A new calculation of the particle trajectory 7 was made and is shown in FIG. 5. By cutting the back side of the body of the ion source, i.e. by creating a notch in the body of the ion source, the beam produced with the first ion source can pass around the second ion source. Due to the symmetry of the twin ion source configuration, the beam produced with the second ion source will also pass around the first ion source.

To further optimize the central region of the cyclotron according to a preferred embodiment of the present invention, two additional modifications can be made, although these modifications can also be made independently from the notch-embodiment. A first modification is to shift the two ion sources towards the centre so that the distance of said first internal ion source 1 and said second internal ion source 2 with respect to the central vertical axis is reduced in order to increase the distance between the beam from said first/second internal ion source after travelling 180° and said second/first internal ion source, whereby particle losses during the first turn of acceleration are minimized. Preferably, the sources are brought into the closest geometry that is technically possible in view of the dimensions of the ion sources. 'Technically possible' takes into account the fact that the two ion sources must be located at a distance of the Dee electrode (3), said distance being such that an electric field between source (1,2) and Dee electrode (3) can accelerate the beam. Also, the two ion sources could not be located side by side into an electric field. Otherwise the particles would be accelerated differently and they could not have the same radius of curvature. As can been seen on FIG. 6, the clearance between the orbit and the second ion source has increased (from about 3 mm to about 8 mm) when compared with FIG. 5.

A second modification that can be made is to modify the shape of the counter Dees (4) in order to remove the corners in the acceleration gaps at (i.e. away from) positions where the orbits cross. It is seen on FIG. 5 that at the second, third and fifth gap crossing, the particle passes close to a bend or corner in the acceleration gap geometry. The result of the modification of the shape of the counter Dees (4) is shown on FIG. 6: the crossings of the gap 5 by the particles takes place at areas where there is no corner or bend in said gap. Preferably, these are areas where the edges are straight and parallel, as seen in the figure. In this way, the gap geometry at the orbit crossings is improved in terms of field-quality, since no more field inhomogeneities are caused by corners (6) of Dee electrodes and counter-Dee electrodes and the field is more uniform. It may be required not only to adapt the geometry of the counter-Dee electrode(s) (4), but also of the Dee electrode(s) (3), in order to obtain this optimal gap geometry.

Figure 6:
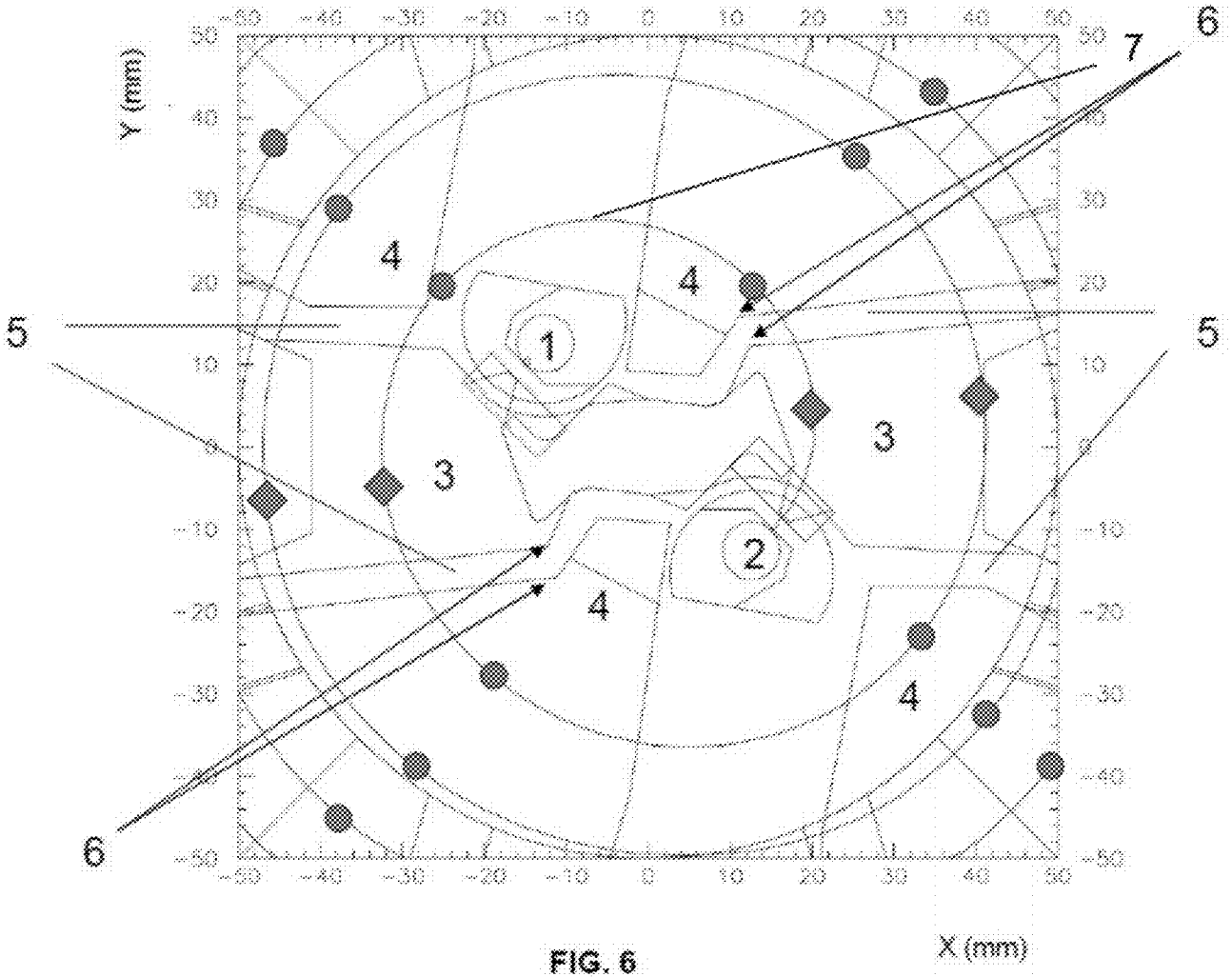
FIG. 6 shows a turn pattern of the ions of the second ion source for an optimized central region configuration according to the invention.
Figure 7:
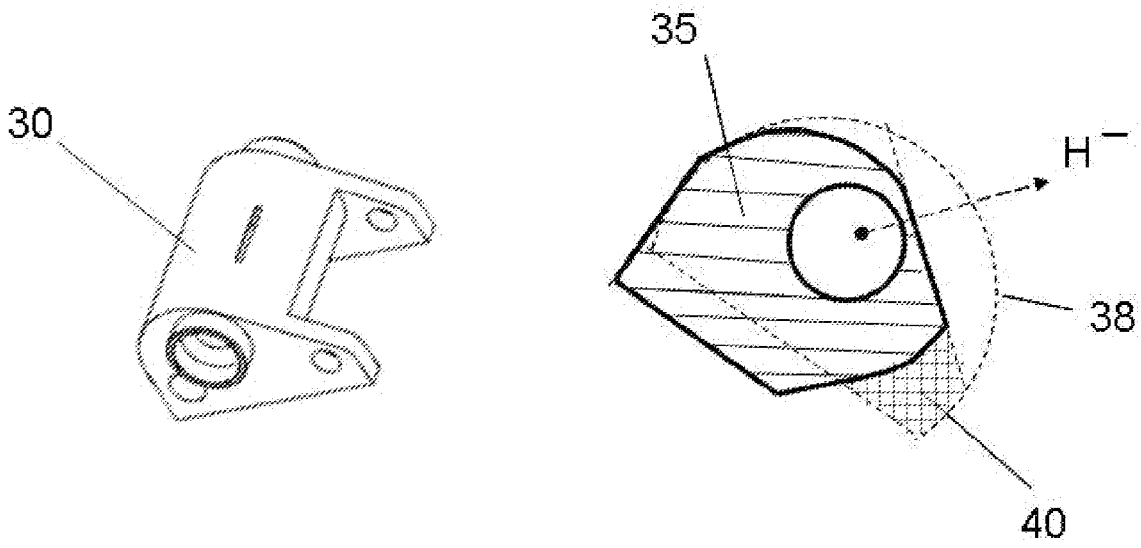
FIG. 7 shows a perspective view and a top view of a section of an internal ion source according to the invention.

Following the results of the calculations shown on FIG. 6, an ion source with a dedicated shape was designed and a three dimensional view is shown on FIG. 7 (30). The top view (35) illustrates the dedicated shape that has been designed to avoid on the one hand ions hitting the back of the ion source during the first turn of acceleration and on the other hand allowing the ion source to fit in a close geometry in the central region of the cyclotron. The optimized dedicated shape shown on FIG. 7 (35) is clearly distinct from the standard ion source shape shown on FIG. 3 (25). The dotted line 38 (FIG. 7) represents the standard shape of the standard ion source represented in FIG. 3. Compared to the standard ion source shape a notch (40) is created on the backside of the ion source. The crossed area (40) on FIG. 7 represents the notch. This notch (40) increases the distance between the beam produced with the first/second ion source after travelling 180° and the body of the second/first ion source.

According to the preferred embodiment of the present invention, the switching from the first ion source to the second ion source or vice versa is completely automated and can be performed from the user interface of the cyclotron control system.

Accordingly, many advantages are reached by using the present invention. In fact, the embodiment of the present invention features the following advantages:

Strong increase in beam uptime and reliability of beam production. Switching to the second spare ion source during production is simple, fast and can be completely automated.

Reduced maintenance. Thanks to the twin ion source system, the global ion source life time is greatly extended and hence the number of maintenance interventions is reduced and personnel exposure to radiation is further limited.

The invention claimed is:

1. A cyclotron for generating a particle beam, said cyclotron comprising:

a first internal ion source which produces particle ions;

a Dee electrode assembly and a counter-Dee electrode assembly separated from each other by gaps for accelerating said particle ions;

a generator configured to apply an alternating high voltage to said Dee electrode assembly, for producing an electric field in said gaps;

a device configured to produce a magnetic field passing vertically through the Dee and counter-Dee electrode assemblies for causing the particle ions to spiral and encounter the accelerating voltage of said Dee electrode assembly, and a second internal ion source which produces the same type of particle ions as said first internal ion source, whereby said cyclotron is configured to generate an energetic particle beam produced by either said first internal ion source or by said second internal ion source, or energetic particle beams produced by both ion sources simultaneously, the cyclotron having a central axis through its center which central axis is parallel with the magnetic field, the first and second internal ion sources having bodies which include a notch at the periphery of the body oriented away from the central axis of the cyclotron, the notch being arranged to avoid collision of the particle beam produced by one internal ion source with the body of the other internal ion source.

2. The cyclotron according to claim 1, wherein the cyclotron has a two-fold rotational symmetry with respect to the central axis.

3. A cyclotron for generating a particle beam, the cyclotron comprising:

a first internal ion source which produces particle ions;

a Dee electrode and a counter-Dee electrode separated from each other by gaps for accelerating the particle ions;

a generator configured to apply an alternating high voltage to the Dee electrode for producing an electric field in the gaps;

a device configured to produce a magnetic field passing vertically through the Dee and counter-Dee electrodes for causing the particle ions to spiral and encounter the accelerating voltage of the Dee electrode, and a second internal ion source which produces the same type of particle ions as the first internal ion source, whereby the cyclotron is configured to generate an energetic particle beam produced by either the first internal ion source or by the second internal ion source, or energetic particle beams by both ion sources simultaneously, the cyclotron having a central vertical axis which is parallel to the magnetic field, the two ion sources positioned at a distance from the Dee and counter-Dee electrodes such that an electric field between the Dee and counter-Dee electrodes accelerate the particle ions, the two ion sources not being in side by side relation and the first and second ion sources positioned relative to the central vertical axis to effect an increase in the distance of ion particle beams from the first and second ion sources after the particle beams travel 180° in the cyclotron.

4. A cyclotron for generating a particle beam, said cyclotron comprising:

a first internal ion source which produces particle ions;

a Dee electrode assembly and a counter-Dee electrode assembly separated from each other by gaps for accelerating said particle ions;

a generator configured to apply an alternating high voltage to said Dee electrode assembly, for producing an electric field in said gaps;

a device configured to produce a magnetic field passing vertically through the Dee and counter-Dee electrode assemblies for causing the particle ions to spiral and encounter the accelerating voltage of said Dee electrode assembly, and a second internal ion source which produces the same type of particle ions as said first internal ion source, whereby said cyclotron is configured to generate an energetic particle beam produced by either said first internal ion source or by said second internal ion source, or energetic particle beams produced by both ion sources simultaneously, the cyclotron having a central axis through its center which central axis is parallel with the magnetic field and the counter-Dee electrode assembly is configured and arranged in such a way such that the particles cross the gaps at areas where there is no corner or bend in the gaps.

5. The cyclotron according to claim 4, wherein the cyclotron has a two-fold rotational symmetry with respect to the central axis.

6. The cyclotron according to claim 3, wherein the counter-Dee electrode assembly and the Dee-electrode assembly are configured in such a way that the crossings of the gaps by the particles takes place at areas where there is no corner or bend in said gaps.

7. The cyclotron according to claim 6, wherein the cyclotron has a two-fold rotational symmetry with respect to the central axis.

* * * * *